United States Patent [19]

Stern et al.

[11] Patent Number: 4,542,357

[45] **Date of Patent: * Sep. 17, 1985**

[54] DIELECTRIC WAVEGUIDE FERRITE RESONANCE ISOLATOR

[75] Inventors: Richard A. Stern, Allenwood; Richard W. Babbitt, Fair Haven, both of N.J.

[73] Assignee: The United States of America as represented by the Secretary of the Army, Washington, D.C.

[ * ] Notice: The portion of the term of this patent subsequent to Jul. 10, 2001 has been disclaimed.

[21] Appl. No.: 517,613

[22] Filed: Jul. 27, 1983

[51] Int. Cl.[4] ..... H01P 1/365; H01P 1/30

[52] U.S. Cl. ..... 333/24.2; 333/248

[58] Field of Search ..... 333/17 L, 22 R, 22 F, 333/24.1, 24.2, 248; 338/51

[56] References Cited

U.S. PATENT DOCUMENTS

| | | | |
|---|---|---|---|
| 3,225,318 | 12/1965 | Heithaus | 333/24.2 |
| 3,246,262 | 4/1966 | Wichert | 333/24.1 X |
| 3,311,853 | 3/1967 | Schiff | 333/21 R |
| 4,064,477 | 12/1977 | Thompson | 338/51 |
| 4,459,567 | 7/1984 | Stern et al. | 333/24.2 |

*Primary Examiner*—Paul Gensler

*Attorney, Agent, or Firm*—Anthony T. Lane; Jeremiah G. Murray; Roy E. Gordon

[57] ABSTRACT

A dielectric waveguide ferrite resonance isolator capable of operating in the millimeter wave frequency range in a dielectric waveguide transmission line in which a thin rectangular hexagonal ferrite material is affixed to a side of the dielectric waveguide and then placed between the pole pieces of an electromagnet in order to magnitize and fully orient the ferrite material is improved by positioning a grooved block of dielectric having a low dielectric constant and high thermal conductivity against the face of the hexagonal ferrite so as to use the high thermal conductivity dielectric as a heat sink thereby extracting heat from the hexagonal ferrite.

20 Claims, 3 Drawing Figures

DIELECTRIC WAVEGUIDE FERRITE RESONANCE ISOLATOR

The invention described herein may be manufactured, used, and licensed by or for the Government for governmental purposes without the payment to us of any royalty thereon.

This invention is an improvement of the invention disclosed and claimed in U.S. Pat. application Ser. No. 387,987 filed 14 June 1982 by Richard A. Stern and Richard W. Babbitt for "Dielectric Waveguide Ferrite Resonance Isolator" now U.S. Pat. No. 4,459,567 with which this application was copending and assigned to a common assignee.

BACKGROUND OF THE INVENTION

U.S. Pat. No. 4,459,567 provides a dielectric waveguide isolator capable of operating in the millimeter wave frequency range in dielectric waveguide transmission line. This is accomplished by using an hexagonal ferrite as for example, a thin rectangular substrate of barium oxide substituted NiCo ferrite affixed to the side of a dielectric waveguide as the resonance isolator. After having bonded the ferrite to the dielectric waveguide, the unit is placed between the pole pieces of an electromagnet to magnetize and fully orient the ferrite material. After this process is completed, there is no further need of magnetic biasing for the isolator.

The difficulty with the dielectric waveguide ferrite resonance isolator of U.S. Pat. No. 4,459,567 is that heat builds up in the ferrite during the absorption of high millimeter wave power for the reverse direction of energy propagation in the isolator. The ferrite, being a very thin slab of low conductivity material being mounted on a magnesium titanate dielectric waveguide (also having low thermal conductivity) typically heats up and quickly loses its nonreciprocal properties and thus renders the isolator useless under high power operating conditions.

SUMMARY OF THE INVENTION

The general object of this invention is to provide an improved dielectric waveguide ferrite resonance isolator capable of handling high levels of millimeter wave average power transmission. A further object of the invention is to provide such an improved dielectric waveguide ferrite resonance isolator in which the ferrite will not heat up and lose its nonreciprocal properties under high power operating conditions. A still further object of the invention is to provide a dielectric waveguide transmission line containing the ferrite resonance isolator to provide low loss transmission of high millimeter wave energy from the input port of the transmission line to the output port of the transmission line while absorbing any millimeter wave energy entering at the output port.

It has now been found that the aforementioned objects can be obtained by positioning a block of dielectric having a low dielectric constant and high thermal conductivity against the face of the hexagonal ferrite.

In this invention, the high thermal conductivity dielectric acts as a heat sink thereby extracting heat from the thin sliver of ferrite. That is, heat builds up in the ferrite during the absorption of high millimeter wave power for the reverse direction of energy propagation in the isolator. The use of the high thermal conductivity dielectric in this invention bleeds the heat off the ferrite and this allows continued isolator operation at reduced temperatures.

DESCRIPTION OF THE DRAWING

Referring to FIG. 1, the isolator is comprised of a thin (0.005") rectangular substrate of barium oxide substituted NiCo ferrite material 10 affixed to the side of a dielectric waveguide 12. A block of dielectric having a low dielectric constant and high thermal conductivity 14 is positioned against the face of the ferrite material 10. The unit is then placed between the pole pieces of an electromagnet in order to magnetize and fully orient the ferrite material. After this process is completed, there is no further need of magnetic biasing for the isolator. The block of dielectric 14 is shown as being grooved to permit better dissipation of heat.

Figure 1:
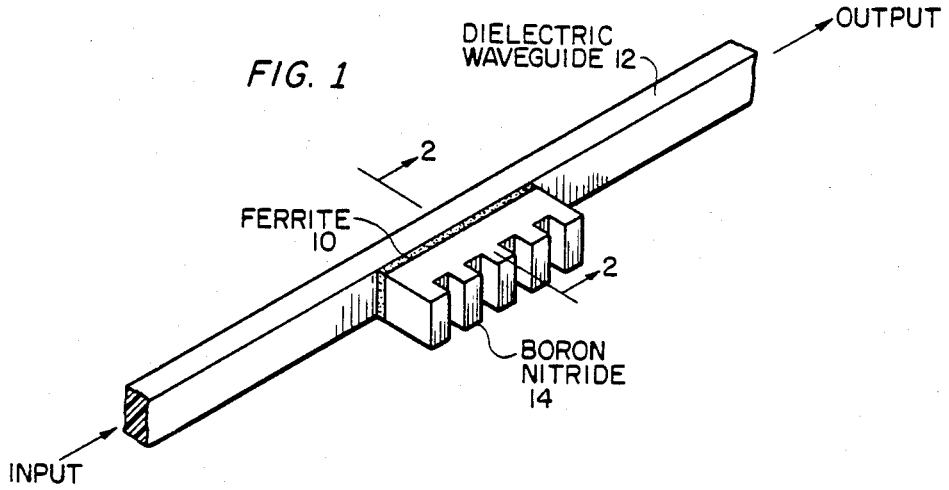
FIG. 1 shows the improved isolator in the form of a thin rectangular substrate of NiCo hexagonal ferrite material affixed to the side of the dielectric waveguide and a block of dielectric having a low dielectric constant and high thermal conductivity positioned against the face of the hexagonal ferrite.
Figure 2:
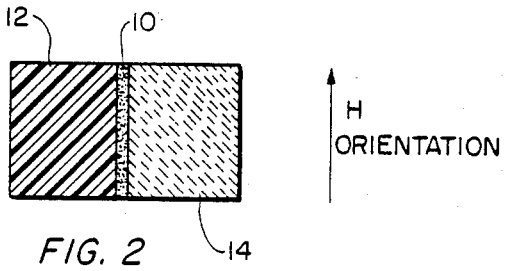
FIG. 2 is a cross-sectional view of the improved isolator indicating the direction of magnetic orientation of the ferrite.

The block of dielectric 14 can conveniently be boron nitride, which has a thermal conductivity of about 18 BTU/FT/HR/FT$^2$/°F. and a relative dielectric constant of $\epsilon'=4$. What allows the use of this design is the fact that the relative dielectric constant of the dielectric waveguide (magnesium titanate) and the hexagonal ferrite are relatively high, on the order of 16 and thus tend to concentrate the millimeter wave energy within themselves. The boron nitride, having a dielectric constant on the order of 4, (significantly lower), does not perturb or significantly effect the propagating wave, yet enhances the transfer of heat from the ferrite. The boron nitride can be affixed to the ferrite by means of a low loss, thermally conductive adhesive or epoxy. The boron nitride has a thickness of about 0.25 inch. The boron nitride can also be utilized in larger bulk and act as a rigid support medium for the isolator.

Thus, the basic dielectric waveguide ferrite resonance isolator as disclosed and claimed in U.S. Pat. No. 4,459,567 that was capable of only operating at milliwatt levels at millimeter frequencies now has the capability of operating at average power levels of tens of watts.

The ferrite material utilized in the isolator and referred to as a hexagonal material may be barium oxide substituted NiCo ferrite, barium oxide substituted NiZn ferrite or barium oxide substituted NiAl ferrite. Such typical hexagonal ferrites have the respective generalized formulas:

$BaO{\cdot}2[Ni_{1-x}Co_x]O{\cdot}7.8Fe_2O_3$ where x is a value from 0 to 0.4;

$BaO{\cdot}2[Ni_{1-y}Zn_y]O{\cdot}7.8Fe_2O_3$ where y is a value from 0 to 1; and, $BaO{\cdot}2NiO{\cdot}\Delta Al_2O_3[7.8-\Delta]$ where $\Delta$ is a value from 0 to 1.

The hexagonal ferrite differs from conventional microwave and millimeter wave ferrite materials in that hexagonal materials are grain-oriented, uniaxial materials having high anisotropy magnetic fields. Conventional ferrites have thousands of randomly oriented crystallites that must be aligned by an external biasing magnet. Hexagonal ferrites, however, have a high anisotropy field defined to have the same magnitude and direction as would be required of an external magnetic field, and hence, can be used to supplement or replace an externally applied field.

The isolator phenomenon occurs due to the interaction between the magnetized ferrite material and the r.f. magnetic field of the propagating millimeter wave. The ferrite, being situated on one side of the dielectric waveguide, incurs little interaction with the millimeter wave propagating in the foward direction. The wave therefore passes through the isolator with little energy loss. In the case of energy propagating in the reverse direction, however, the ferrite couples energy out of the propagating wave resulting in a significant amount of energy loss through absorption by the ferrite. This nonreciprocal effect is based on the fact that the ferrite encounters the negatively circular polarized region of the r.f. magnetic field for forward direction of wave propagation. No energy coupling occurs in this instance and the wave continues on with little loss. The ferrite, however, finds itself in the positively circular polarized region of the r.f. magnetic field for wave propagation in the reverse direction. In this case, the ferrite interacts strongly with the wave and couples energy from the wave resulting in high attenuation of the wave propagating in the isolator.

An alternate design employs a second slab of ferrite, identical to the first except that the second slab is placed on the opposite side wall of the dielectric waveguide and has its magnetic orientation in a direction opposite to that of the first ferrite. This second ferrite enhances the isolation effect, permitting the length of the isolator to be shortened. A block of dielectric having a low dielectric constant and high thermal conductivity is positioned against the face of the second slab of ferrite so as to use the high thermal conductivity dielectric as a heat sink thereby extracting heat from the second slab of ferrite.

Figure 3:
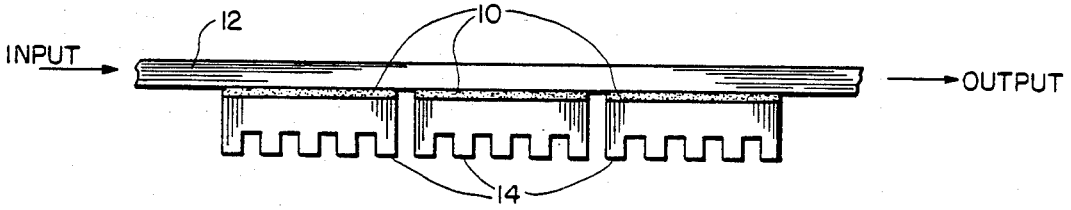
FIG. 3 shows an additional number of ferrites or ferrite isolators with a block of dielectric having a low dielectric constant and high thermal conductivity positioned against the face of each of the hexagonal ferrites.

A second alternate design is shown in FIG. 3. In this device design, an additional number of ferrites or ferrite isolators are installed in series on the side wall of dielectric waveguide 12. Each ferrite, in this case, functions over different but contiguous frequency bands. The result is a combined broadband isolator. A block of dielectric 14 having a low dielectric constant and high thermal conductivity is positioned against the face of each ferrite so as to use the high thermal conductivity dielectric as a heat sink thereby extracting heat from each ferrite.

There are no ferrite resonance isolators presently available which operate in the dielectric waveguide transmission line for use in the millimeter wave frequency region of 40 GHz to 220 GHz. Dielectric waveguide, which is now finding extensive use in this frequency region, requires various control components such as isolators in order to be functional in military electronics systems and subsystems.

The following are operating characteristics of a dielectric waveguide transmission line according to the invention:

Center Frequency—35.4GHz
Bandwidth—10%
Insertion Loss—1dB
Isolation—20dB
Voltage Standing Wave Ratio—1.2:1

The purpose of the two port dielectric waveguide transmission line according to the invention is to provide low loss transmission of millimeter wave energy from the input port to the output port. However, any energy entering at the output port is absorbed by the isolator and thus is not transmitted through to the input port. The unit therefore is nonreciprocal, allowing transmission in only one direction. The unit can therefore be used to protect signal generators from other undesirable and damaging signal sources.

The ferrite 10 according to the invention has a thickness of about 5 mils. The ferrite is rectangular in shape and has a height the same as the height of the dielectric waveguide 12 and the block of dielectric 14. The length of the ferrite 10 will depend on the particular ferrite composition used. The length will generally be in the range of about 0.050 inch to about 0.300 inch. The length of the ferrite 10 will be the same as the length of the block of dielectric 14. The thickness of the block of dielectric 14 can be varied from 0.25 inch to 0.5 inch.

The ferrite 10 can be conveniently bonded to the dielectric waveguide 12 with a low electrical loss epoxy type adhesive such a Scotch-Weld Structural Adhesive as marketed by the 3M Company of St. Paul, Minn.

As the dielectric waveguide material 12, one may use a material having a loss tangent at microwave frequencies of less than $4\times10^{-4}$ and a dielectric constant from about 9 to about 30. Such materials are exemplified by magnesium titanate and alumina of which magnesium titanate is preferred.

Other modifications are seen as coming within the scope of the invention. For example, one might design a resonance isolator to operate at other frequencies by selecting the appropriate hexagonal ferrite composition and by modifying the physical dimensions.

We wish it to be understood that we do not desire to be limited to the exact details as described for obvious modifications will occur to a person skilled in the art.

What is claimed is:

1. In a dielectric waveguide ferrite resonance isolator capable of operating in the millimeter wave frequency range in a dielectric waveguide transmission line in which a thin rectangular hexagonal ferrite material is affixed to a side of the dielectric waveguide and then placed between the pole pieces of an electromagnet in order to magnetize and fully orient the ferrite material, the improvement of positioning a grooved block of dielectric having a low dielectric constant and high thermal conductivity against the face of the hexagonal ferrite so as to use the high thermal conductivity dielectric as a heat sink thereby extracting heat from the hexagonal ferrite.

2. A dielectric waveguide ferrite resonance isolator according to claim 1 wherein the hexagonal ferrite material is selected from the group consisting of barium oxide substituted nickel cobalt ferrite, barium oxide substituted nickel zinc ferrite, and barium oxide substituted nickel aluminum ferrite.

3. A dielectric waveguide ferrite resonance isolator according to claim 2 wherein the hexagonal ferrite material is barium oxide substituted nickel cobalt ferrite.

4. A dielectric waveguide ferrite resonance isolator according to claim 2 wherein the hexagonal ferrite material is barium oxide substituted nickel zinc ferrite.

5. A dielectric waveguide ferrite resonance isolator according to claim 2 wherein the hexagonal ferrite material is barium oxide substituted nickel aluminum ferrite.

6. A dielectric waveguide ferrite resonance isolator according to claim 1 wherein the height of the block of dielectric is the same as the height of the dielectric waveguide and the height of the hexagonal ferrite material.

7. A dielectric waveguide ferrite resonance isolator according to claim 1 wherein the thickness of the rectangular substrate of hexagonal ferrite material is about 0.005 inch and wherein the thickness of the block of dielectric is about 0.25 inch.

8. A dielectric waveguide ferrite resonance isolator according to claim 1 wherein the length of the block of dielectric is the same as the length of the rectangular substrate of hexagonal ferrite material.

9. A dielectric waveguide ferrite resonance isolator according to claim 8 wherein the length of the block of dielectric is about 0.050 inch to about 0.300 inch.

10. A dielectric waveguide ferrite resonance isolator according to claim 1 wherein the block of dielectric is affixed to the hexagonal ferrite with a low loss, thermally conductive adhesive.

11. A dielectric waveguide ferrite resonance isolator according to claim 1 wherein the dielectric waveguide is composed of a material having a loss tangent at microwave frequencies of less than $4\times10^{-4}$ and a dielectric constant from about 9 to about 30.

12. A dielectric waveguide ferrite resonance isolator according to claim 11 wherein the dielectric waveguide is composed of a material selected from the group consisting of magnesium titanate and alumina.

13. A dielectric waveguide ferrite resonance isolator according to claim 12 wherein the dielectric waveguide material is magnesium titanate.

14. A dielectric waveguide ferrite resonance isolator according to claim 12 wherein the dielectric waveguide material is alumina.

15. In a dielectric waveguide ferrite resonance isolator according to claim 1 wherein a second thin rectangular substrate of hexagonal ferrite material identical to the first is placed on the opposite side wall of the dielectric waveguide and has its magnetic orientation in a direction opposite to that of the first hexagonal ferrite material thus enhancing the isolation effect and permitting the length of the ferrite to be shortened, the improvement of positioning a second block of dielectric having a low dielectric constant and high thermal conductivity against the face of the second hexagonal ferrite so as to use the high thermal conductivity dielectric as a heat sink thereby extracting heat from the second hexagonal ferrite.

16. In a dielectric waveguide ferrite resonance isolator capable of operating in the millimeter wave frequency range in a dielectric waveguide transmission line wherein said isolator comprises a thin rectangular substate of about 0.005 inch thick of barium oxide substituted NiCo ferrite affixed to the side of dielectric waveguide composed of alumina by means of a low electrical loss epoxy type adhesive and wherein the height of the rectangular ferrite substrate is the same as the height of the dielectric waveguide, and wherein the hexagonal ferrite material is then placed between the pole pieces of an electromagnet in order to magnetize and fully orient the ferrite material, the improvement of positioning a grooved block of dielectric having a low dielectric constant and high thermal conductivity against the face of the hexagonal ferrite so as to use the high thermal conductivity dielectric as a heat sink thereby extracting heat from the hexagonal ferrite.

17. In a dielectric waveguide ferrite resonance isolator according to claim 16 wherein a second thin rectangular substrate identical to the first is placed on the opposite side wall of the dielectric waveguide and has its magnetic orientation in a direction opposite to that of the first hexagonal ferrite material thus enhancing the isolation effect and permitting the length of the ferrite to be shortened, the improvement of positioning a second grooved block of dielectric having a low dielectric constant and high thermal conductivity against the face of the second hexagonal ferrite so as to use the high thermal conductivity dielectric as a heat sink thereby extracting heat from the second hexagonal ferrite.

18. In a combined broadband isolator wherein a series of thin rectangular substrates of hexagonal ferrite material is affixed on the side wall of a dielectric waveguide with equal spacing between each substrate, and with each of said ferrite substrates functioning over different but contiguous frequency bands, the improvement of positioning a grooved block of dielectric having a low dielectric constant and high thermal conductivity against the face of each hexagonal ferrite material so as to use the high thermal conductivity dielectric as a heat sink thereby extracting heat from each hexagonal ferrite.

19. In a dielectric waveguide transmission line containing a dielectric waveguide ferrite resonance isolator therein capable of operating in the millimeter wave frequency range wherein said isolator comprises a thin rectangular substrate of hexagonal ferrite material that has been affixed to a side of the dielectric waveguide and then placed between the pole pieces of an electromagnet to magnetize and fully orient the ferrite material, the improvement of positioning a grooved block of dielectric having a low dielectric constant and high thermal conductivity against the face of the hexagonal ferrite so as to use the high thermal conductivity dielectric as a heat sink thereby extracting heat from the hexagonal ferrite.

20. A dielectric waveguide transmission line according to claim 19 having an input port and an output port.

* * * * *